US005613799A

United States Patent [19]

Guide

[11] Patent Number: 5,613,799

[45] Date of Patent: Mar. 25, 1997

[54] ROTATING FLASH DEVICE AND METHOD

[76] Inventor: David Guide, 203 Eastgate Rd., Lombard, Ill. 60148

[21] Appl. No.: 480,009

[22] Filed: Jun. 7, 1995

Related U.S. Application Data

[63] Continuation-in-part of Ser. No. 183,075, Jan. 18, 1994.

[51] Int. Cl.[6] ..... G09F 11/00

[52] U.S. Cl. ..... 404/9; 40/412; 40/431; 40/612

[58] Field of Search ..... 404/6, 9; 40/602, 40/612, 473, 406, 412, 422, 440, 441, 430, 431, 466, 479, 480, 493, 502; 116/46, 48, 63 R, 63 P, 63 C, 63 T

[56] References Cited

U.S. PATENT DOCUMENTS

| | | | |
|---|---|---|---|
| 2,985,976 | 5/1961 | Parker | 40/440 |
| 3,374,763 | 3/1968 | Browning | 40/440 X |
| 3,590,505 | 7/1971 | Benchley, Jr. | 40/473 |
| 3,638,341 | 2/1972 | Holmes | 40/602 X |
| 3,964,190 | 6/1976 | Leo | 40/412 |
| 4,353,179 | 10/1982 | Jennings | 40/431 X |
| 4,910,898 | 3/1990 | Hector | 40/602 X |
| 5,085,075 | 2/1992 | Baker | 40/412 X |
| 5,323,728 | 6/1994 | Hjelm | 40/602 X |

*Primary Examiner*—William P. Neuder
*Attorney, Agent, or Firm*—Fitch, Even, Tabin & Flannery

[57] ABSTRACT

A method and apparatus for creating the appearance of on and off flashes of light and of moving to attract the attention of an observer is provided. A moveable support is provided, rotatable about an axis with first and second reflective materials thereon at horizontally and vertically spaced locations thereon on opposite sides of the axis of rotation. The reflective material is rotated to bring the reflective materials into the line of sight of an observer on opposite sides of the rotational axis and then moving the reflective material from the line of sight of the observer. Light is directed from a light source towards the rotatable member to cause the first reflective materials on opposite sides of the rotational axis and moving it into the observer's line of sight to flash on and then to flash off at first positions as the first reflective materials travel from the observer's line of sight and to cause the second reflective materials following the first reflective materials moving into the observer's line of sight to flash on and then to flash off at second positions as the second reflective materials travel from the observer's line of sight with the appearance that first reflective materials are shifted in the axial direction to the second position's to provide the appearance of flashes of light moving in the axial direction on opposite sides of the axis.

39 Claims, 7 Drawing Sheets

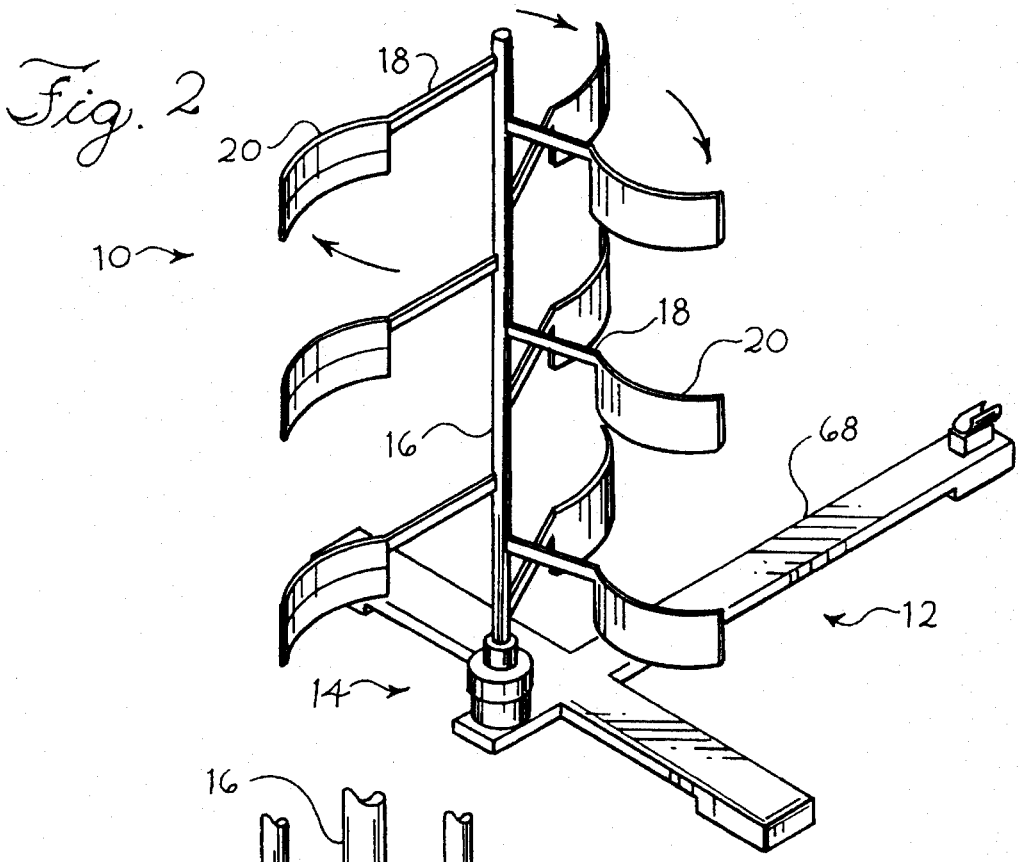
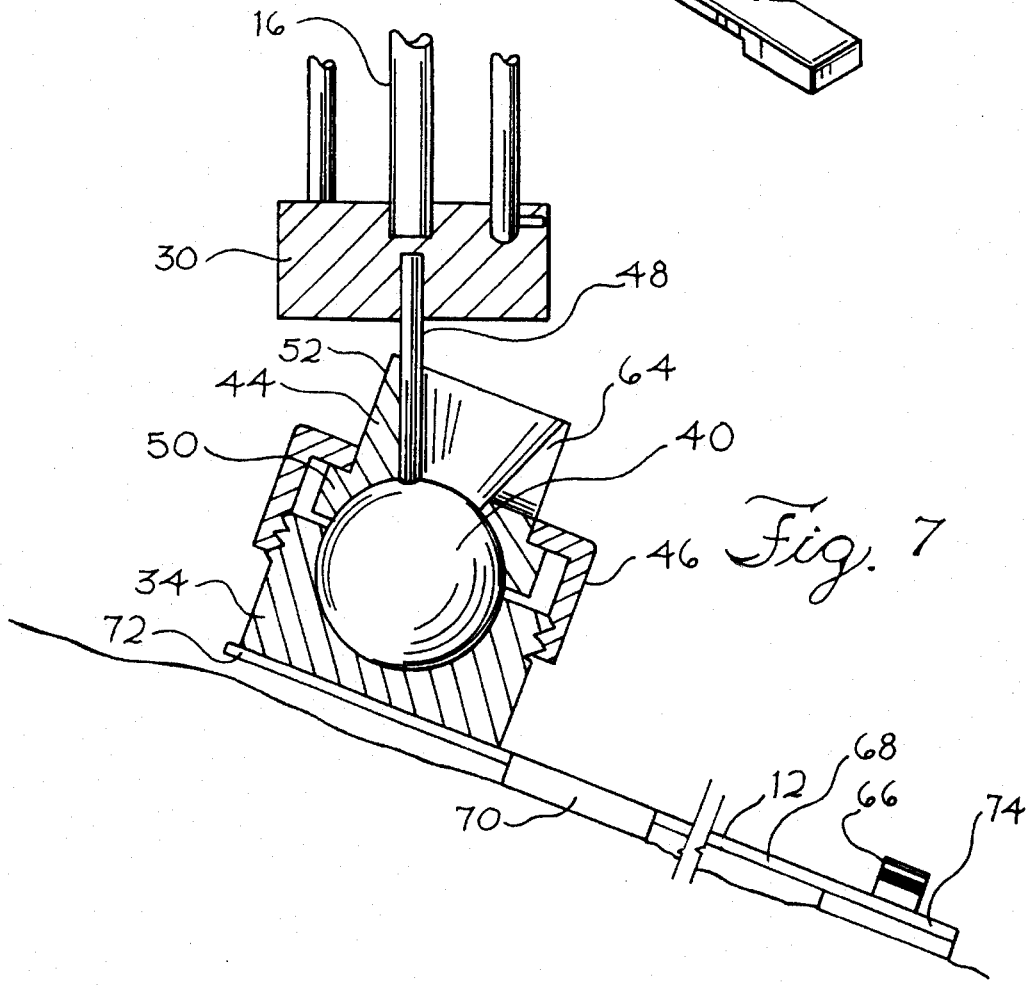
Fig. 7

Fig. 5
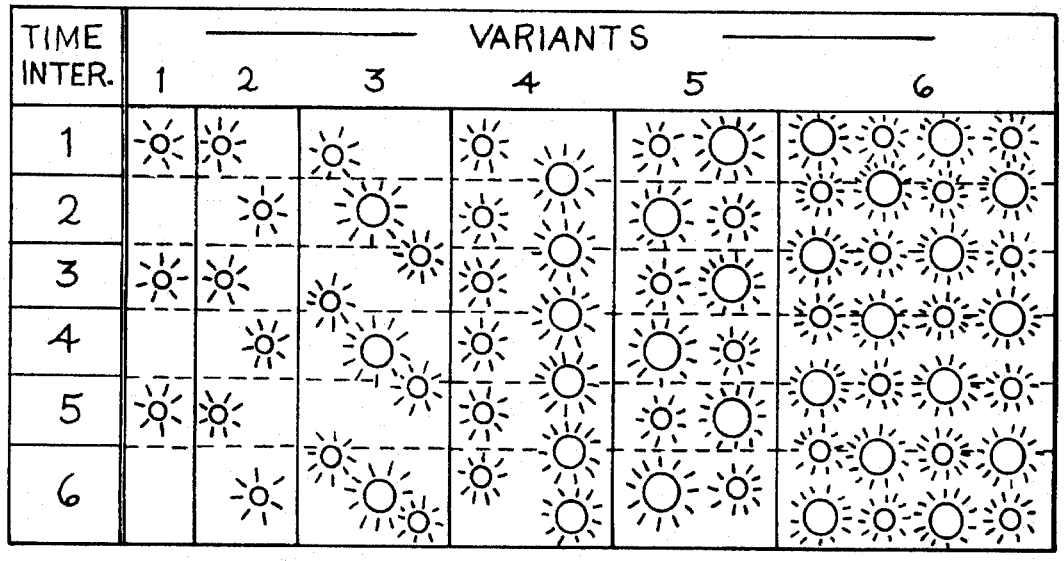
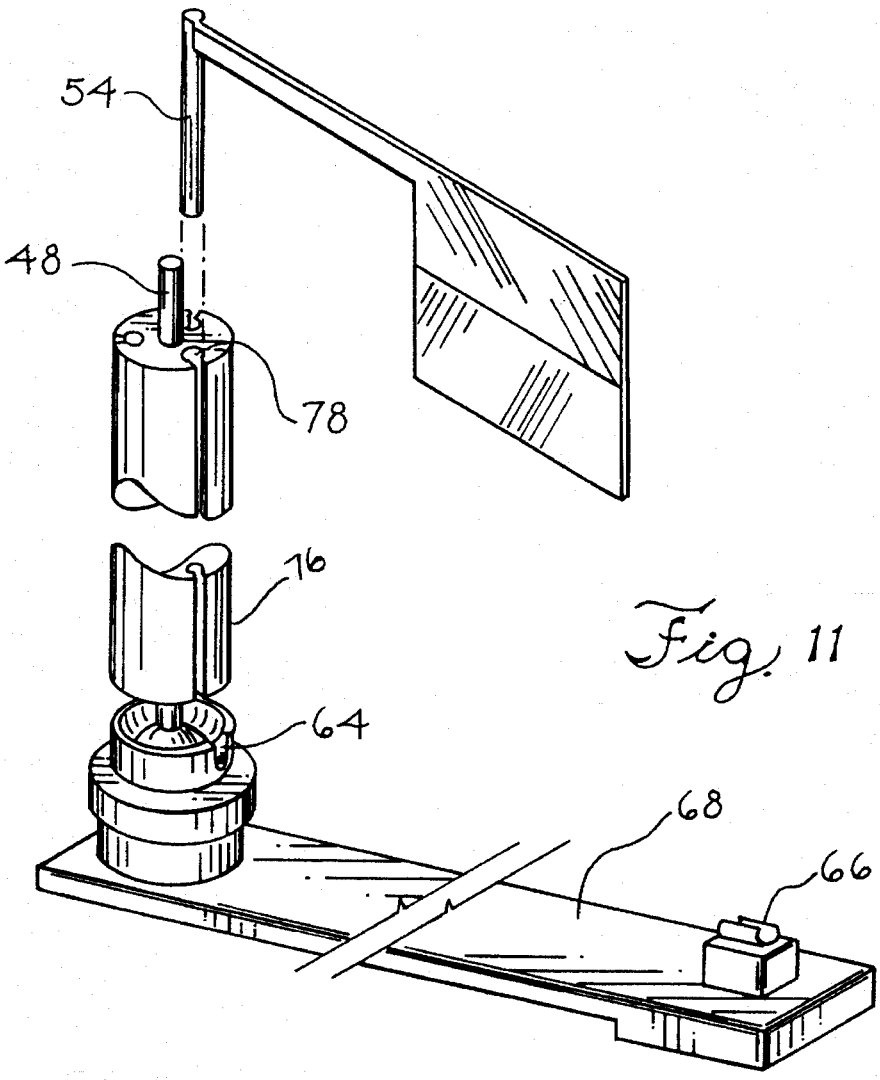
Fig. 11

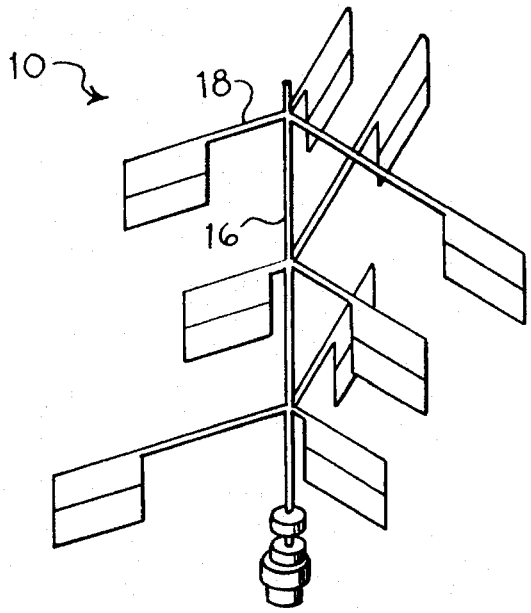
Fig. 8
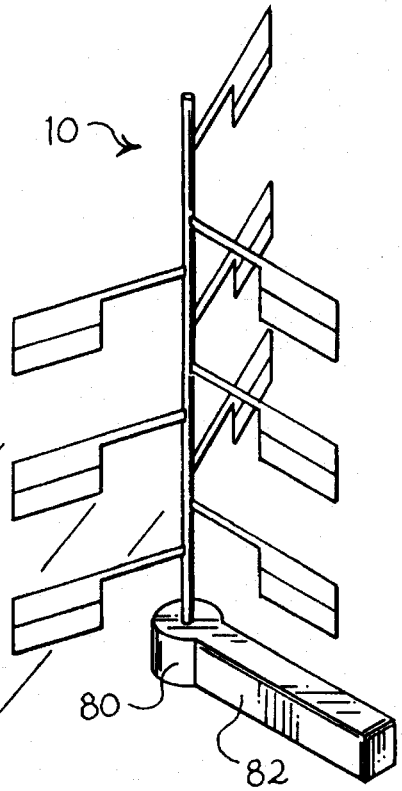
Fig. 10
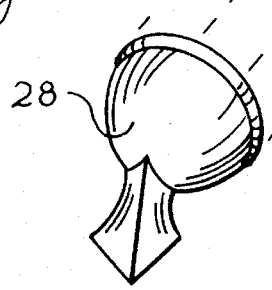
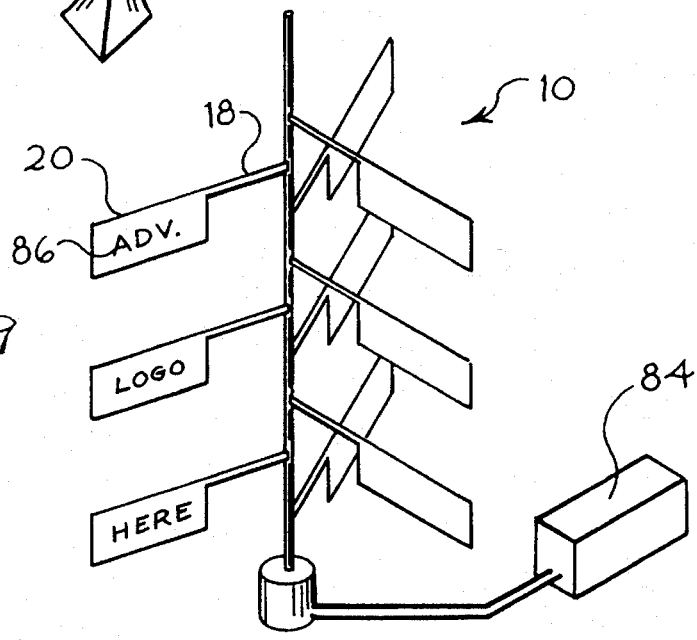
Fig. 9

ROTATING FLASH DEVICE AND METHOD

RELATION TO THE OTHER APPLICATIONS

This application is a continuation-in-part of U.S. patent application Ser. No. 08/183,075, filed on Jan. 18, 1994, which is hereby incorporated by reference.

FIELD OF THE INVENTION

The present invention relates to a method and apparatus for attracting the attention of an observer and, more specifically, to a method and apparatus for creating the appearance of on-off flashes of light With rotating reflective material to attract the attention of an observer.

BACKGROUND OF THE INVENTION

It is common to use fairly large stationary signs, such as billboards, alongside roads to catch the attention of passers-by for advertising and the like. Neon signs and billboards have been used extensively to attract attention. Moreover, it is also fairly typical to see such signs and billboards utilizing electrically powered means to create movement by moving a member mounted to the sign or attempting to create the illusion of movement by causing lights to sequentially flash on to create an image, such as with marquee signs which create the appearance of the occurrence of writing of a word(s) across the sign by sequentially lighting lights forming the letters of the word(s). Further, it is common to use electric flashing lights to attract the attention of an observer such as along roadways where construction is occurring, where dangerous sections of road are upcoming, and alongside airport runways and the like. They are also commonly used with emergency vehicles. While the use of such electrically powered attention-getters can be effective, they are subject to failure, require large energy costs and can be fairly irritating and offensive to an observer's normal vision, such as by impairing their vision on roadways when emergency vehicles pass with their electrically powered lights flashing.

It is also known to use stationary reflectors alongside roads, particularly on road signs to attract the attention of passers-by. Further, although rotating signs are known, they do not flash on either side of their display area or central axis. Similarly, in U.S. Pat. No. 4,353,179 a rotatable wind-driven sign is disclosed having three vertical panels with reflective material on one panel spaced vertically relative to reflective material on the other panels such that upon rotation of the panels the reflective material can give the appearance of vertical motion only along the axis of rotation as the sign rotates. Because of the use of the panels' mounting reflective material, the viewing angle in which the reflective material is visible on one panel at a certain time is limited to approximately 160°. Another problem is that the '179 device requires that the sign rotate at an optimum speed to obtain a flashing effect—too slow and there will be little or no flashing; and, too fast, and the reflective indicia becomes a blur with the rotating panels appearing to a solid cylinder.

The above-described panels slightly overlap one another. The overlapping portions are intended to catch wind to rotate the sign. A problem with this design of the '179 patent is that by utilizing overlapping portions which project only slightly from the panel from which they overlap, the wind-catching ability of the overlapping portion is reduced. Further, any increase in the size of the overlap portion detracts from the aesthetics of the sign. In addition, by the use of panels, the appearance of indicia movement is somewhat limited by the size of the panels. Finally, the '179 device is a fairly bulky sign that is not readily transported to and from sites of use.

SUMMARY OF THE INVENTION

In accordance with the present invention, a method and apparatus of creating the appearance of on and off flashes of light and of moving to attract the attention of an observer is provided which overcomes the aforementioned problems of the prior art.

The method includes the steps of providing a movable support rotatable about an axis with first and second reflective materials thereon at horizontally and vertically spaced locations thereon on opposite sides of the axis of rotation. The reflective material is rotated to bring the reflective materials into the line of sight of an observer on opposite sides of the rotational axis and then moving the reflective material from the line of sight of the observer. Light is directed from a light source towards the rotatable member to cause the first reflective materials on opposite sides of the rotational axis and moving it into the observer's line of sight to flash on and then to flash off at first positions as the first reflective materials travel from the observer's line of sight and to cause the second reflective materials following the first reflective materials moving into the observer's line of sight to flash on and then to flash off at second positions as the second reflective materials travel from the observer's line of sight with the appearance that first reflective materials are shifted in the axial direction to the second position's to provide the appearance of flashes of light moving in the axial direction on opposite sides of the axis.

In one form, the method includes the step of directing collimated light toward the reflective materials and providing a coating for the support to render the support substantially less visible to the observer.

In another form of the invention, the method includes the steps of providing a rotatable longitudinally extending member rotatable about an axis of rotation and having a plurality of flash portions thereon extending away from the axis as the member rotates with the flash portions having reflective flash material thereon. The reflective material is spaced in an axial direction and is moved. Light from a light source is directed towards the rotating member causing the reflective material on the portions to create an abrupt on and off flashing at either side of the axis where the movement of the portions through their respective paths is not readily detectable producing an apparent rectilinear jerky type motion of the portions on either side of the axis.

The method can further include the step of driving the member for rotation at a preselected speed from one of several speeds available.

The method can include the step of producing the apparent rectilinear portion motion including reciprocating motion in a direction perpendicular to the central axis.

The method can include the step of producing the apparent rectilinear portion motion including reciprocating motion in a direction parallel to the central axis.

The directing step can include the step of producing collimated light from the light source.

The method can include the step of providing a light absorptive coating for significantly reducing the visibility of the member and arms when light is directed towards the rotating member with the flashing portions appearing to be unsupported as they rotate. The light absorptive coating can be a flat black coating on the rotatable member and the arms.

In another aspect of the invention, an apparatus for creating in a line of sight of an observer the appearance of on and off flashes of light at spaced locations and the appearance of moving to attract the attention of the observer is provided. The apparatus includes a rotatable support rotatable about an axis. The first reflective materials on the rotatable support spaced radially outwardly of the axis of rotation, being carried by the support in an endless path of travel into and from the line of sight of the observer. Second reflective materials ar provided on the rotatable support spaced radially outwardly of the axis and spaced both longitudinally and transversely of the first reflective materials and being rotated by the rotatable support into and from the line of sight of the observer. A base is provided for mounting the movable support for receiving directed light thereon and for rotating to bring the first reflective materials into the observer's line of sight to flash on and then to flash off at first positions on one side of the rotational axis and then to subsequently bring the second reflective materials into the observer's line of sight to flash on and then to flash off at second positions to give the appearance that first reflective materials have shifted between the first and second positions.

In one form, the base mounts the support for rotation about a fixed axis and arms are mounted on the support to carry and to space the first reflective materials from the second reflective materials axially, radially and angularly about the fixed axis of rotation.

A motor can rotate the support and the arms carrying the reflective material and a collimated light source can provide the light to eliminate the reflective material.

In another form of the invention, a rotating sign assembly including an electrically passive flasher system is provided including a rotatable element and structure for supporting the element for rotation. A central longitudinally extending member is mounted to the rotatable element defining a central axis of rotation. A plurality of arms are mounted for rotation with the element extending away from the central axis of rotation and having a portion distal from the axis as the element rotates. The portions have opposed sides including light reflective material on both sides. Structure for causing the element and arms to rotate is provided with the portions moving through an endless path about the central axis such that, from a reference location spaced outwardly from the path and with a light source directed thereat one side of the portions is visible as it traverses a first path portion along the path and the other side of the portions is visible as it traverses a second path portion along the path with intermediate points in each path portion equally spaced about the central axis creating an abrupt on and off flashing on either side of the central axis where the movement of the portions through their respective paths is not readily detectable to produce an apparent jerky-type motion of the portions on either side of the axis.

The arms can be arranged in reference planes containing the axis. The reference planes can be angularly spaced about the axis with arms in a plane being linearly spaced from each other along the axis.

The arms can be provided in three equally spaced planes. The arms in at least two planes can be of equal length and be spaced at different longitudinal positions along the member with respect to each other to provide the apparent rectilinear portion motion with a reciprocating motion component in a direction parallel to the central axis.

The arms of at least two planes can be of different lengths and be spaced at the same longitudinal position along the member with respect to each other to provide the apparent rectilinear portion motion with a reciprocating motion component in a direction perpendicular to the central axis.

The light reflective material can be retro-reflective material.

The rotating structure can include an electric motor for rotatably driving the rotatable element.

The distal portions of the arms can have a rectangular shape. In one form, the rectangular distal portions are curved to catch wind for causing the rotatable element and arms to rotate.

The arms can extend transversely from rods mounted to the rotatable element extending parallel and spaced around the central member. The rotatable element can include detent structure for allowing the arms to move between (1) an open position where the arms on one of the rods are angularly spaced from the arms on another of the rods, and (2) a collapsed position, where the arms on the one rod move towards the arms on the other rod during a sudden increased rotation rate condition of the rotatable element and back to the open position when the increased rotation rate condition no longer exists. The detent structure can include a V-groove in the rotatable element and biasing structure for normally urging the one rod downwardly into the V-groove in the open position.

The support structure can include a base and a ball rod mounted on the base rotatable element rotating about the rod. The structure for folding the rotatable element and rod into a folded position on the base can be provided. The base can include a clip spaced from the rotatable element with the folding structure including a ball-engaging locator having a cut-out therein such that the cut-out can be positioned facing the clip allowing the rotatable element to be folded into a locked position in the clip.

BRIEF DESCRIPTION OF THE DRAWINGS

FIG. 2 is a perspective view of a rotatable assembly showing a central support having arms extending therefrom and being mounted to a base;

FIG. 5 is a table showing variations in flashing patterns generated by the rotatable assembly of the present invention;

FIG. 7 is a elevation view partially in section illustrating the fastening system for the rotatable assembly with the base mounted to a slanted surface;

FIG. 8 is a perspective view of a slightly modified version of the rotatable assembly according to the present invention showing arms of different lengths around the central support;

FIG. 9 is an alternative embodiment of a rotatable assembly according to the present invention driven for rotation by a motor with advertising indicia on the flashing portions;

FIG. 10 is an alternative version of the rotatable assembly according to the present invention including an alternator and battery pack for driving the assembly for rotation; and FIG. 11 is a perspective view of another embodiment of the rotatable assembly according to the present invention having a modified central support.

DETAILED DESCRIPTION OF THE PREFERRED EMBODIMENTS

The method and apparatus of the present invention includes an electrically passive flasher system which provides the appearance of flashing upon either side of a central axis of rotation which itself is not readily detectable to an observer. The present invention accomplishes such attention getting by means of a rotatable assembly generally designated 10 which has a wide variety of outdoor and indoor use where it is desired to attract the attention of an observer to the assembly 10. The flashing effect produced by the rotatable assembly 10 has a pulsing characteristic and can create the appearance of rectilinear movement in an infinite number of patterns, depending on how the rotatable assembly 10 is constructed. Further, the flashing effect when using reflectors utilizes ambient light which is much more pleasing to an observer's normal vision versus, for example, electrically powered flashing lights as on emergency vehicles. Moreover, the flashing effect generated by the rotatable assembly 10 does not depend on the angle at which an observer views the assembly such that at a single point in time observers viewing the rotatable assembly 10 from positions spaced all around the rotatable assembly 10 will see very similar flashing effects at the very same point in time, as well as a similar appearance of movement during the same time interval.

Figure 1:
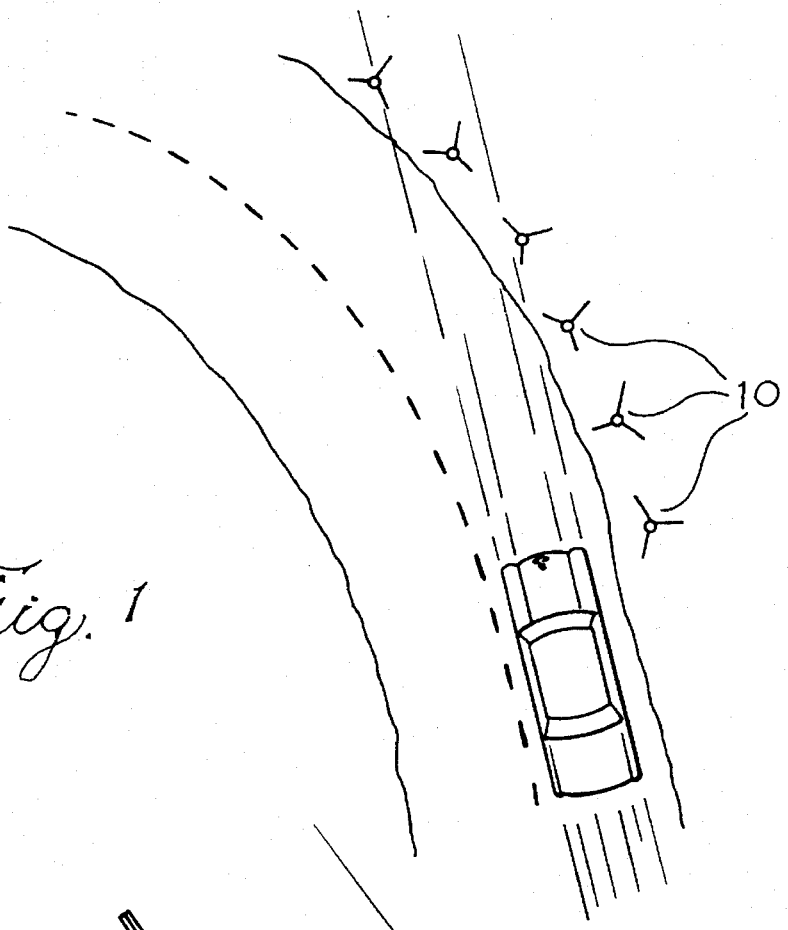
FIG. 1 is a schematic view of rotatable assembly 10 according to the present invention positioned alongside of a curve in a road.

Thus, the rotatable assembly 10 is particularly adapted for outdoor use to mark dangerous curves in roadways, as illustrated in FIG. 1, and as marine buoy markers, and the like. In fact, particularly when used outdoors, the assembly 10 generally has improved attention-arresting capabilities the further away an observer is from the assembly, as the support structure becomes less visible relative to the flashing portions as the distance therefrom increases. To more specifically describe one preferred embodiment, reference made to FIG. 2 showing a rotatable assembly mounted on a base structure 12. The rotatable assembly 10 can include a rotatable element generally designated 14 and a central longitudinally extending support 16 mounted to the rotatable element 14 for rotation therewith about a fixed support axis 16*a*. The central support 16 can have arms 18 extending outwardly therefrom with the arms 18 each including an enlarged flash portion or panel 20 at the end of the arms 18 spaced outwardly from the support 16. Reflective material 22 can be attached to the flash portions 20 on either side thereof to increase the flashing effect created by the rotatable assembly 10, particularly during night-time outdoor use. The reflective material 22 can have a predetermined critical angle beyond which light hitting the reflective material 22 will not be reflected and preferably is retro-reflective material. For outdoor used it is preferred that the enlarged portions 20 be curved as in FIG. 2 so as to more readily catch wind causing the rotatable element 14 to spin. A Teflon bearing system can be utilized to support the total weight of the rotatable elements 14, central support 16, and arms 18 to facilitate the spinning action of the same.

Figure 4:
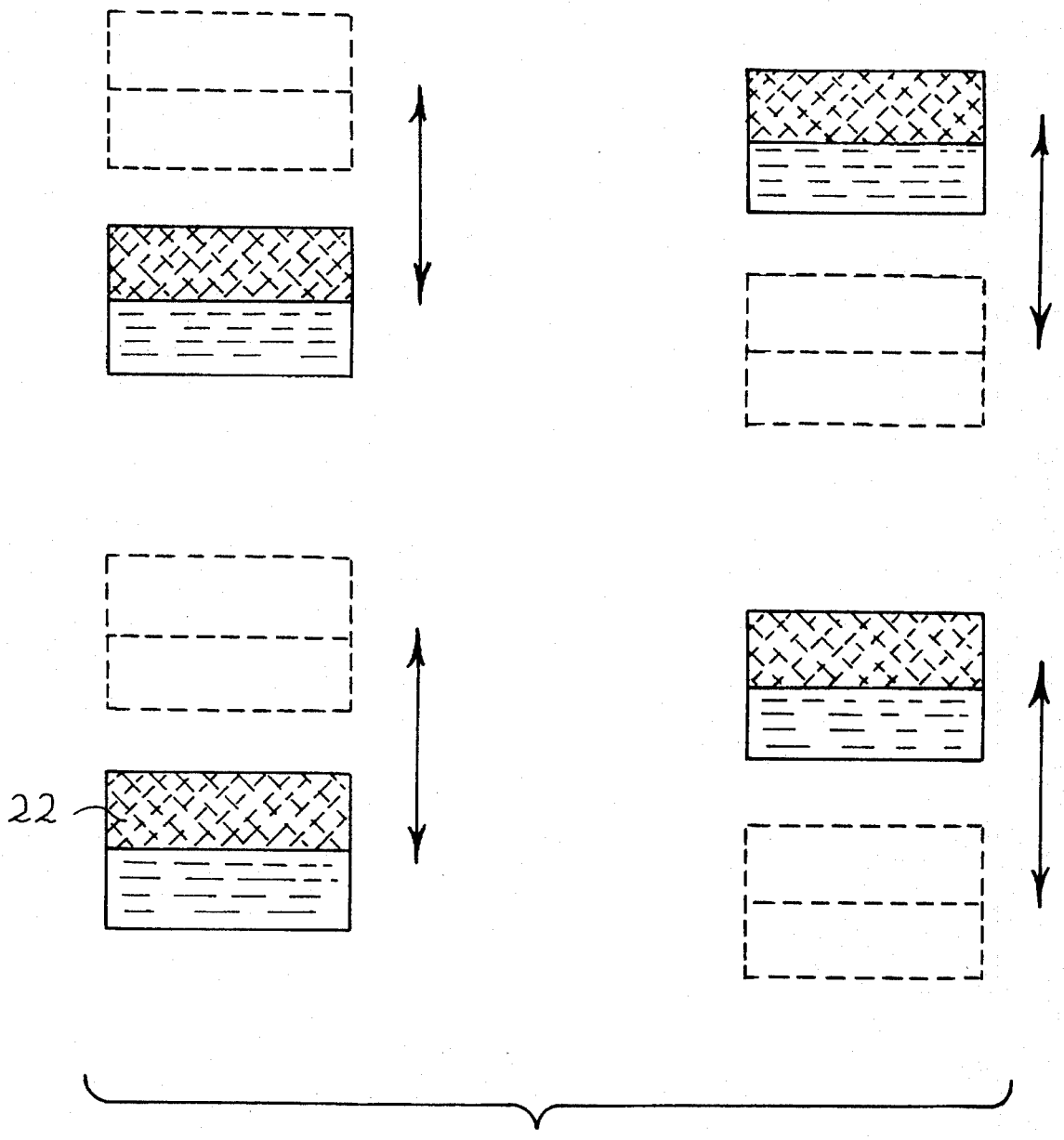
FIG. 4 is a schematic representation of the appearance of movement of the flash portions on either side of the central support.
Figure 12:
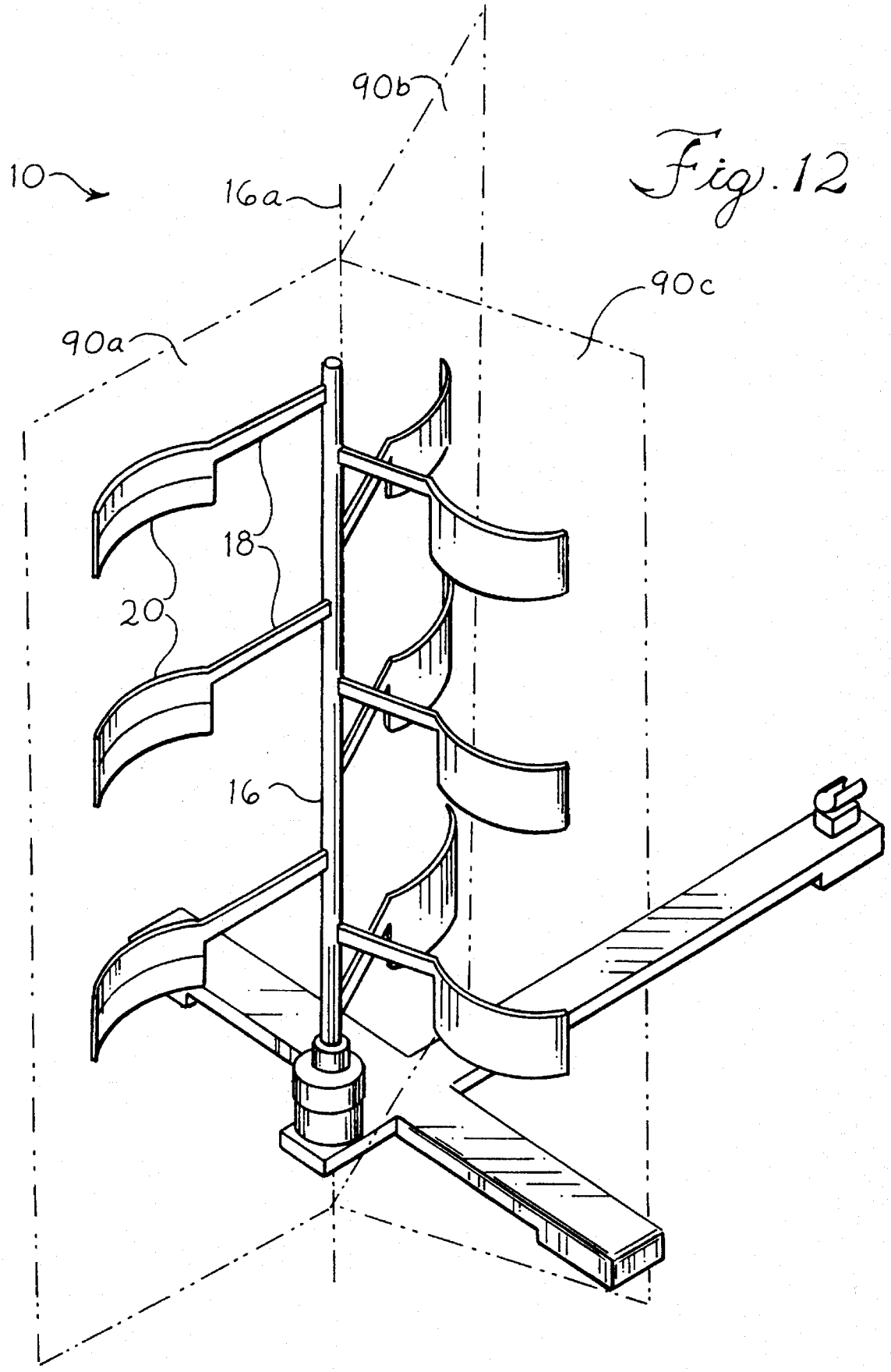
FIG. 12 is a perspective view of the rotatable assembly similar to FIG. 2 showing the reference planes in ghost along which respective arms and their flash portions are arranged.

Thus, by providing the flash portion 20 of the arms 18 with reflective material 22 on both sides of the portion, the flashing effect produced by the rotatable assembly 10 is readily observable from any position around the rotatable assembly 10. Moreover, the rotatable assembly 10 can create the appearance of movement on either side of the central support 16 of the flash portions 20 and the arms can be spaced angularly about the central support in reference planes 90*a*, 90*b* and 90*c* (FIG. 12) with the arms in each reference plane being vertically spaced from arms in another reference plane, such as in FIGS. 2 and 12. In this manner, the appearance of a vertical up and down movement is created as the arms in one plane rotate into the line of sight such that the observer views the flash portions on either side of the central support 16 in the solid line position, illustrated in FIG. 4. Thereafter, the portions 20 move from the line of sight of the observer with portions in another plane moving into the line of sight of the observer on the respective sides of the central support 16 such that the flash portions appear to have moved to a second position indicated in ghost in FIG. 4. The appearance of movement can be further enhanced by either making the support 16 and arms 18 from non-reflective, light absorptive material, or creating the same with light absorptive coating. While rotation of assembly 10 illustrated in FIG. 2 creates the appearance of vertical movement along each side of the central support 16, it is apparent that a wide variety of movements can be obtained by varying the spacing of the arms vertically, horizontally and angularly relative to the central support 16. Thus, FIG. 8 illustrates an embodiment wherein at corresponding vertical positions along the central support 16, arms 18 in different planes are spaced horizontally outward from the central support 16 at different positions to create the appearance of movement in a direction perpendicular to the central support. Other variations can be employed using a combination of horizontal and vertical movement to produce rectilinear flashing patterns along each side of the central support 16.

Figure 3:
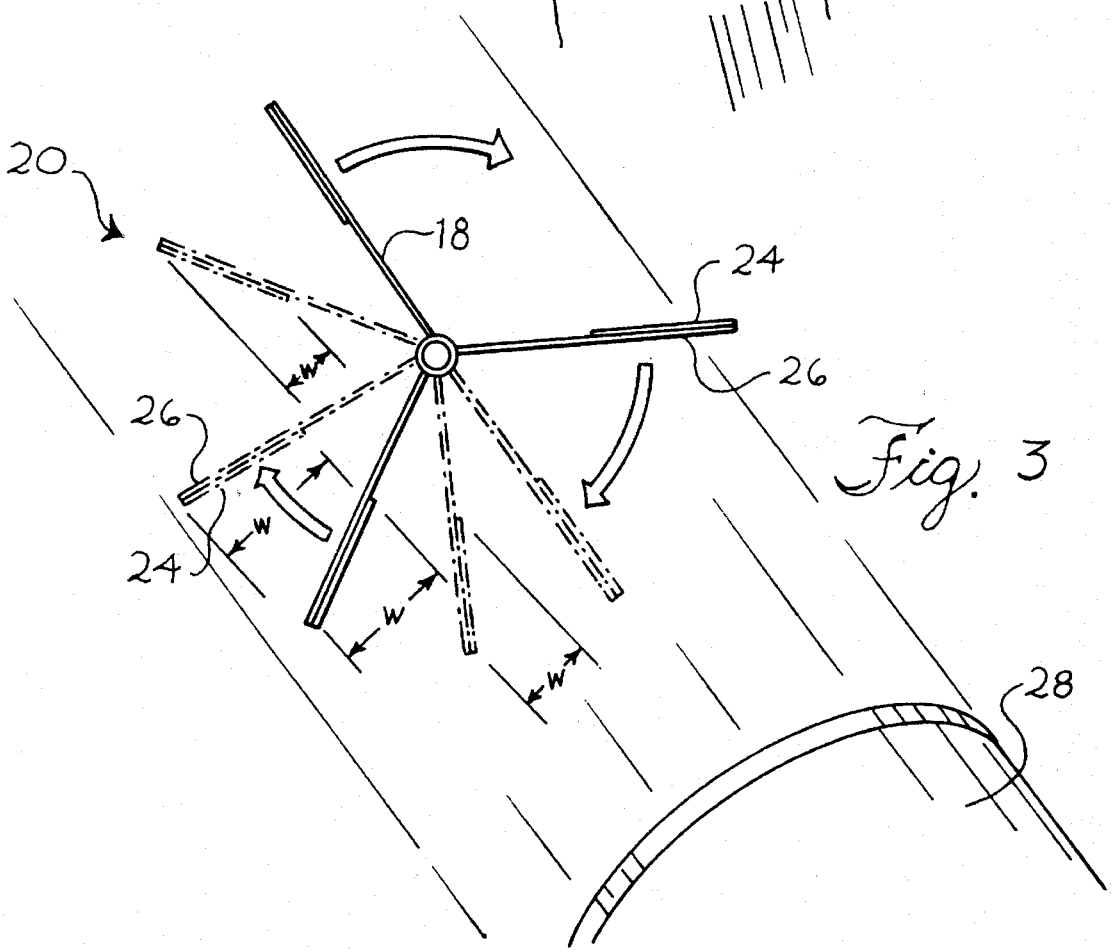
FIG. 3 is a plan view of a rotatable assembly having light from a collimated light source directed thereat.

The rotatable assembly 10 described herein also attracts attention while providing an enhanced flashing or pulsing effect on either side of the central support 16. The geometry of the rotating assembly 10 contributes to the pulsing effect as the flash portions 20 can travel in a circular or orbital patterns thus presenting the flash portion 20 at a continuously changing angle relative to an observer having their line of sight substantially perpendicular to the central support 16. If using reflective material 22 on the flash portions 20, once the critical angle of the reflective material 22 has been passed, the flash will initiate with the flash growing until it reaches its brightest point when flash portion 20 has the side 24 thereof completely facing the observer as where the width labeled "W" in FIG. 3 has its greatest length. Immediately thereafter, the flash will decrease until it reaches the critical angle and passes out of sight whereupon the next flash portion 20 will be presented to the observer and proceed to produce a pulsing flash in the same fashion. Further contributing to the pulsing effect and the somewhat jerky motion created thereby is the appearance that the flash appears to abruptly flash on and off and jump to the next position according to the predetermined spacing of the arms in successive planes. This effect can be enhanced by using retro-reflective material having a smaller critical angle than regular reflective material such that an observer does not see a strong flashing until the flash portion 20 has reached a point closer to the position where the sides 24 and 26 are completely facing towards the line of sight of the observer. This is particularly effective where a collimated light source 28, such as with car headlights, is the source of light reflected by the reflective material on the flash portions 20. FIG. 5 is a table of the some of the variant patterns of flashing that can be produced along the side of the central support 16 during several time intervals thus illustrating the numerous variations of flashing patterns which can be created with the rotatable assembly described herein by changing the positioning of the arms relative to each other and the support.

Figure 6:
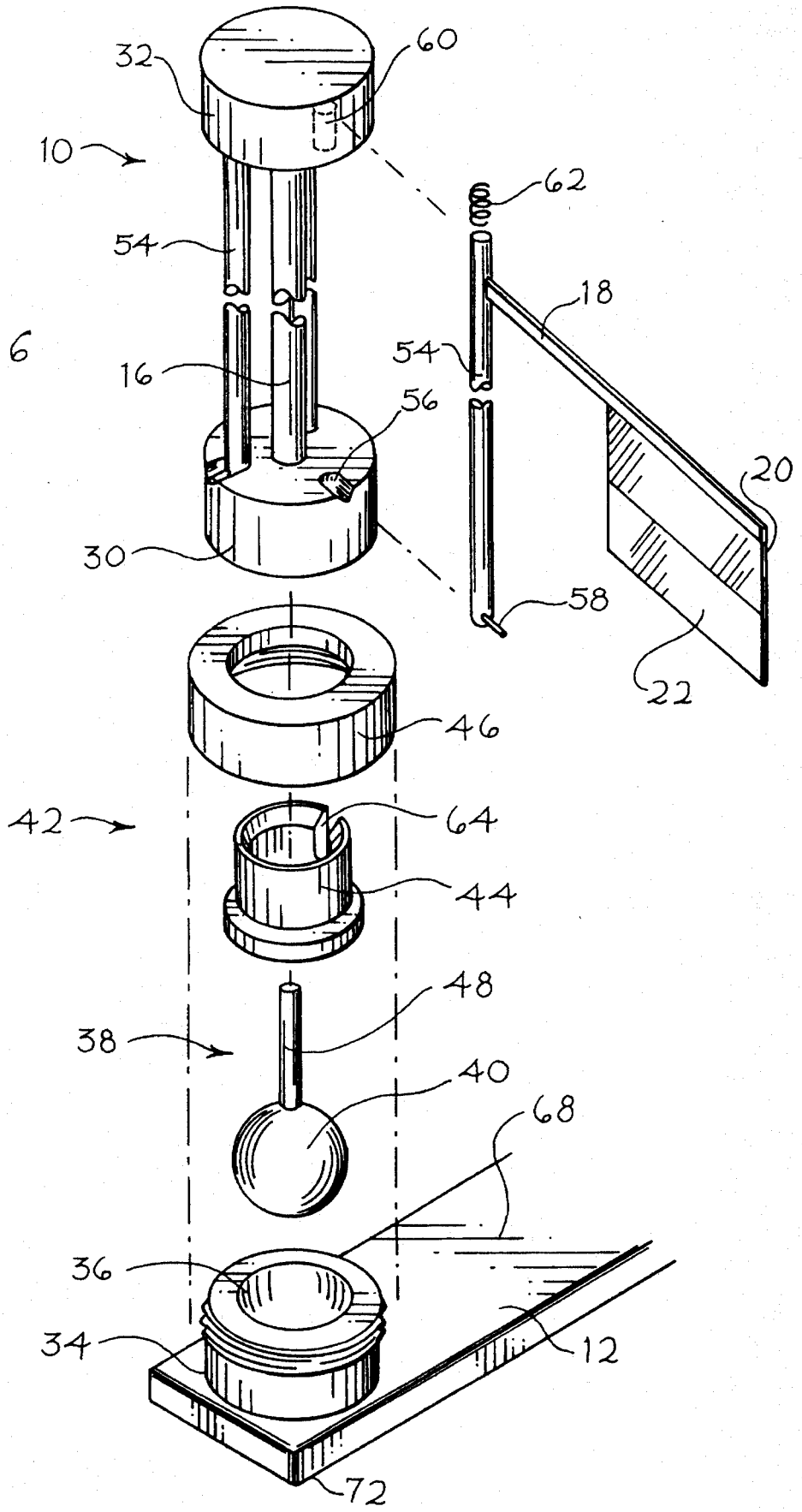
FIG. 6 is an exploded perspective view of one preferred form of the rotatable assembly according to the present invention.

Referring to FIGS. 6 and 7 another preferred form of the rotatable assembly 10 is illustrated. In the rotatable assembly of FIGS. 6 and 7, the central support 16 is mounted for rotation in a bottom flange 30 and a top flange 32 with the support 16 extending therebetween. The base structure 12 includes a ball receiving upright portion 34 attached thereto with the upright portion 34 having a dish shaped recess 36 for receiving a ball therein. A ball rod 38 is provided having a ball 40 sized to rest in recess 36. To securely maintain the ball 40 on the upright portion 34, a fastening system 42 clamps down onto the ball 40 and portion 34. The fastening system 42 includes a ball engaging member 44 and an annular cap retainer 46. The assembly of the fastening system 42 to the upright portion 34 is best seen in FIG. 7. To assemble the above, the ball 40 is first placed on the upright portion 34 in the recess 36 with a rod 48 connected to the ball extending outwardly from the upright portion 34 at a predetermined position, as more fully described herein. Thereafter, the member 44 is threaded over the rod 48 and onto the ball 40 such that inner lower wall ball engaging portions 50 can be pressed down onto the ball 40. Once the rod 48 is positioned as desired with the ball engaging member 44 on the ball 40, the cap retainer 46 can be screwed onto the upright portion 34 so as to exert a clamping force by tightening the ball 40 between the ball engaging portions 50 and the recess surface 36. In this manners the ball rod 38 is in a secured position relative to the base 12. In addition, the ball rod need not extend upwardly from the base 12 in a perpendicular direction as the rod 48 can be angled relative to the ball engaging member 44 only limited by contact with the upper lip 52 thereof, as illustrated in FIG. 7. In this manner, the rotatable assembly 10 can be adapted for use on uneven surfaces, such as diverse terrain encountered in outdoor uses, while still allowing the rotatable assembly 10 to be in a substantially upright position.

The central support 16 can be hollow for receipt of the rod 48 therein. Preferably the rod is longer than the central support 16 so as to extend through the central support 16 until it engages the top flange 32 thereby spacing the bottom flange 30 from the fastening system 42 during operation of the rotatable assembly 10. As seen in FIG. 6, dowel rods 54 can be used to mount the arms 18 around the central support 16. Preferably, the dowel rods 54 include one dowel rod which is rigidly mounted between the bottom and top flanges, 30 and 32. The remaining dowel rods 54 are preferably mounted between the bottom and top flanges, 30 and 32, such that the arms 18 carried by those dowel rods 54 can collapse towards the arms 18 carried by the rigidly mounted dowel rod, such as when a large gust of wind hits the rotatable assembly 10 producing a sudden increased rotation rate condition. In this manner, the rotatable assembly 10 more readily avoids being toppled over by such a large wind gust, while simultaneously allowing the collapsed arms to reposition back to their non-collapsed state when the large gust has subsided.

To allow the rotatable assembly 10 to operate as described above despite such large wind gusts, the collapsible dowel rods 54 are spring loaded downwardly into a V-groove 56 in the bottom flange 30. The collapsible dowel rods 54 can be provided with a lower pin 58 extending therefrom to engage the V-groove surface 56. A cavity 60 is provided in the top flange 32 for the collapsible dowel rods with the cavity including a small spring 62 therein such that with the collapsible dowel rods 54 inserted in the cavity 60, the dowel rod, and accordingly the pin 58 are urged downwardly towards the bottom of the V-groove 56. When a large gust of wind hits the flash portions 20 on the collapsible dowel rods 54 the dowel rods will tend to rotate in the V-groove against the bias force of the spring 62 with the pin moving out of the V-groove 56 and extending towards the fixed dowel rod. In this fashion, the flash portions 20 on the collapsible dowel rods will rotate together with the flash portions 20 of the fixed dowel rod substantially adjacent to one another until the sudden increased rotation rate condition, i.e. wind gust, subsides whereupon the centrifugal force of rotation will cause the pin to rotate back into the V-groove 56 in a substantially fixed position.

The rotatable assembly 10 can also be provided with structure that allows the rod 48 to be folded down towards the base 12. To accommodate such downward movement, the ball engaging member 44 includes a cut-out as at 64 which can be aligned with locking clip 66. Preferably, the base structure 12 includes an elongate member 68 with a cross elongate member 70 pinned thereto for pivoting therewith. The elongate member 68 has space ends 72 and 74 with the rotatable assembly 10 being mounted to the elongate member 68 at the end 72 and with the clips 66 mounted to the member 68 at the end 74 thereof.

Thus, the use of a ball engaging member 44 having the cut-out 64 allows the rod 48 and therefore the central support 16 and associated elements to receive an impact force, as by an automobile, and fold down so as to limit the damage to assembly 10. More importantly the assembly can be readily folded in a compact fashion for portability to various sites of use. To fold the assembly 10, the cross member 70 can be pivoted so that it is substantially aligned with the elongate member 68. Thereafter, the collapsible dowel rods can be moved to their collapsed position and their arms 18 positioned in a direction extending away from the locking clip(s) 66 so that when the rod is folded through the cut-out 64, either the central supports 16 or the rods 54 can be lockingly inserted into associated clips 66. As is apparent from the above description, the number of clips 66 can be varied on the end 74 of the elongate member 68 to accommodate dowel rods 54 or, when a single central support 16 is used (FIG. 2), to accommodate the support 16.

Alternative embodiments possible with the rotatable assembly 10 described herein will be described next keeping in mind that many other variations are possible in keeping with the spirit of the invention disclosed hereby. In FIG. 11, a modified rotatable assembly 10 is illustrated wherein the bottom flange 30 and central support 16 are replaced with an enlarged diameter central rod 76 having cut-out slots 78 substantially conforming to the shape of the dowel rods 54 to tightly receive the same therein. Similar to the previously described assembly 10, the dowel rods 54 can be rotated together so that they are in a collapsed position before the rod 48 is folded down through the cut-out 64 with either the rod 48 or the dowel rods being received in clip(s) 66.

FIG. 9 is an assembly 10 specifically designed for indoor use, although it can also be used in outdoor applications, wherein a motor 84 is used to power the assembly for rotation. The arms 18 can include advertising indicia 86 on the flash portions 20. Preferably, the indicia will be formed from reflective material 22 to enhance the flashing effect to attract potential customers' attention. Even more preferably, the assembly of FIG. 9 can have a collimated light source 28 directed thereat so as to improve the flashing effect thereof.

FIG. 10 illustrates another embodiment wherein an alternator 80 is used to recharge a battery pack 82 through the rotation of the assembly 10. In this manner, the assembly 10 can be driven for rotation, for example in outdoor applications when the wind has died down and the assembly is no longer rotating.

While the invention has been described with regards to its preferred embodiments which constitute the best modes known to the inventor, it should be understood that various changes and modifications may be made without departing from the scope and spirit of the invention which is intended to be set forth in the claims appended hereto.

I claim:

1. A method for arresting the attention of an observer, such as in a moving vehicle, the method comprising:

providing a rotatable longitudinally extending member rotatable about an axis of rotation and having a plurality of arms including enlarged flash portions thereon extending radially away from the axis as the member rotates with the flash portions having reflective flash material thereon;

spacing the reflective flash material in an axial direction;

moving the reflective material; and directing light from a light source towards the rotating member causing the reflective material on the portions to create an abrupt on and off flashing at either side of the axis where the movement of the arms through their respective paths is not readily detectable producing an apparent rectilinear jerky-type motion of the portions on either side of the axis.

2. The method of claim 1 further including the step of driving the member for rotation at a preselected speed from one of several speeds available.

3. The method of claim 1 including the step of producing the apparent rectilinear portion motion including reciprocating motion in a direction perpendicular to the central axis.

4. The method of claim 1 including the step of producing the apparent rectilinear portion motion including reciprocating motion in a direction parallel to the central axis.

5. The method of claim 1 wherein the directing step includes the step of producing collimated light from the light source.

6. The method of claim 1 including the step of providing a light-absorptive coating for significantly reducing the visibility of the member and arms when light is directed towards the rotating member with the flashing portions appearing to be unsupported as they rotate.

7. The method of claim 6 including the step of providing a flat black coating on the rotatable member and the arms.

8. An apparatus for creating in a line of sight of an observer the appearance of on-off flashes of light at spaced locations and the appearance of moving to attract the attention of the observer, said apparatus comprising:

a rotatable support rotatable about a fixed axis;

first reflective materials on the rotatable support spaced radially outwardly of the axis of rotation being carried by the support in an endless path of travel into and from the line of sight of the observer;

second reflective materials on the rotatable support spaced radially outwardly of the axis and spaced both longitudinally and transversely of the first reflective materials and being rotated by the rotatable support into and from the line of sight of the observer; and a base mounting the moveable support for receiving directed light thereon and for rotating to bring the first reflective materials into the observer's line of sight to flash on and then to flash off at first positions on one side of the rotational axis and then to subsequently bring the second reflective materials into the observer's line of sight to flash on and then to flash off at second positions to give the appearance that first reflective materials shifted between the first and second positions wherein arms are mounted on the support and extend radially outwardly therefrom to carry and space the first reflective materials from the second reflective materials axially, radially and angularly about the fixed axis of rotation.

9. An apparatus in accordance with claim 8 wherein:

a motor rotates the support and the arms carry the reflective material; and a collimated light source provides the light to illuminate the reflective material.

10. A rotating sign assembly including an electrically passive flasher system, the assembly comprising:

a rotatable element;

means for supporting the element for rotation;

a central longitudinally extending member mounted to the rotatable element defining a central axis of rotation;

a plurality of arms mounted for rotation with the element extending substantially radially away from the central axis of rotation and having a portion distal from the axis as the element rotates, the portions having opposed sides including light-reflective material on both sides;

means for causing the element and arms to rotate with the arms and their portions moving through an endless path about the central axis such that from a reference location spaced outwardly from the path and with a light source directed thereat one side of the portions is visible as it traverses a first path portion along the circular path and the other side of the portions is visible as it traverses a second path portion along the circular path with intermediate points in each path portion equally spaced about the central axis creating an abrupt on and off flashing at either side of the central axis where the movement of the arms through their respective paths is not readily detectable to produce an apparent jerky-type motion of the portions on either side of the axis.

11. The assembly of claim 10 wherein the arms are arranged in reference planes containing the axis, the reference planes being angularly spaced about the axis with arms in a plane being linearly spaced from each other along the axis.

12. The assembly of claim 11 wherein the arms are in three equally spaced planes.

13. The assembly of claim 11 wherein arms in at least two planes are of equal length and are spaced at different longitudinal positions along the member with respect to each other to provide the apparent rectilinear portion motion with a reciprocating motion component in a direction parallel to the central axis.

14. The assembly of claim 11 wherein the arms in at least two planes are of different lengths and are spaced at the same longitudinal position along the member with respect to each other to provide the apparent rectilinear portion motion with a reciprocating motion component in a direction perpendicular to the central axis.

15. The assembly of claim 10 wherein the light-reflective material is retro-reflective material.

16. The assembly of claim 10 wherein the rotating means includes an electric motor for rotatably driving the rotatable element.

17. The assembly of claim 10 wherein the distal portions of the arms have a rectangular shape.

18. The assembly of claim 17 wherein the rectangular distal portions are curved to catch wind for causing the rotatable element and arms to rotate.

19. The assembly of claim 10 wherein the arms extend transversely from rods mounted to the rotatable element extending parallel to and spaced around the central member.

20. A rotating sign assembly including an electrically passive flasher system, the assembly comprising:

a rotatable element;

means for supporting the element for rotating a central longitudinally extending member mounted to the rotatable element defining a central axis of rotation;

a plurality of arms mounted for rotation with the element extending away from the central axis of rotation and having a portion distal from the axis as the element rotates, the portions having opposed sides including light-reflective material on both sides;

means for causing the element and arms to rotate with the portions moving through an endless path about the central axis such that from a reference location spaced outwardly from the path and with a light source directed thereat one side of the portions is visible as it traverses a first path portion along the circular path and the other side of the portions is visible as it traverses a second path portion along the circular path with intermediate points in each path portion equally spaced about the central axis creating an abrupt on and off flashing at either side of the central axis where the movement of the portions through their-respective paths is not readily detectable to produce an apparent jerky-type motion of the portions on either side of the axis, wherein the arms extend transversely from rods mounted to the rotatable element extending parallel to and spaced around the central member and the rotatable element includes detent means for allowing the arms to move between (1) an open position wherein the arms on one of the rods are angularly spaced from the arms on another of the rods, and (2) a collapsed position wherein the arms on the one rod move towards the arms on the other rod during a sudden increased rotation rate condition of the rotatable element and move back to the open position when the increased rotation rate condition subsides.

21. The assembly of claim 20 wherein the detent means comprises a V-groove in the rotatable element and biasing means for normally urging the one rod downwardly into the V-groove in the open position.

22. A rotating sign assembly including an electrically passive flasher system, the assembly comprising:

a rotatable element;

means for supporting the element for rotation;

a central longitudinally extending member mounted to the rotatable element defining a central axis of rotation;

a plurality of arms mounted for rotation with the element extending away from the central axis of rotation and having a portion distal from the axis as the element rotates, the portions having opposed sides including light-reflective material on both sides;

means for causing the element and arms to rotate with the portions moving through an endless path about the central axis such that from a reference location spaced outwardly from the path and with a light source directed thereat one side of the portions is visible as it traverses a first path portion along the circular path and the other side of the portions is visible as it traverses a second path portion along the circular path with intermediate points in each path portion equally spaced about the central axis creating an abrupt on and off flashing at either side of the central axis where the movement of the portions through their respective paths is not readily detectable to produce an apparent jerky-type motion of the portions either side of the axis wherein the support means includes a base and a ball rod mounted on the base with the rotatable element rotating about the rod and further including means for folding the rotatable element and rod into a folded position on the base.

23. The assembly of claim 22 wherein the base includes a clip spaced from the rotatable element and the folding means comprises a ball engaging locator having a cut-out therein such that the cut-out can be positioned facing the clip allowing the rotatable element to be folded into a locked position in the clip.

24. A method for creating the appearance of separate unconnected flashes on either side of a fixed axis to an observer by flash panels which are rotatable about the axis, the flashes appearing at a first position on one side of the axis and a second position on the other side of the axis, the method comprising:

providing a first flash panel and a second flash panel distinct from the first flash panel with the panels spaced radially outwardly from the axis;

orienting the first and second flash panels so that the first panel and axis define a first reference plane which extends radially from the axis with the first panel generally extending along the first reference plane and the second panel and axis define a second reference plane which extends radially from the axis with the second panel generally extending along the second reference plane; and rotating the panels about the axis to move the first and second flash panels through the first and second positions, respectively, to cause the appearance of flashing as the panels are moved through the respective first and second positions on either side of the axis with the flashes at the first and second positions appearing to be unconnected relative to each other.

25. The method of claim 24 wherein the rotating step includes rotating the first flash panel away from the first position towards a third position on the other side of the axis, the panels being oriented so that the third position is spaced from the second position and then rotating the first panel away from the third position and back towards the first position to cause the appearance of a flash as the first flash panel is moved through the third position, and rotating the second flash panel away from the second position towards a fourth position on the one side of the axis, the panels being oriented so that the fourth position is spaced from the first position and then rotating the second panel away from the fourth position back towards the second position to cause the appearance of a flash as the second flash panel is moved through the fourth position with the flashes at the third and fourth positions appearing to be unconnected relative to each other.

26. The method of claim 25 wherein the panels are oriented so that the first and third positions are spaced from each other on the one side of the axis in at least one of a radial and an axial direction relative to the support axis and the second and fourth positions are spaced from each other on the other side of the axis in the at least one of the radial and axial directions to cause the appearance of unconnected flashes on either side of the axis which are spaced in the one direction from following flashes on the same side of the axis.

27. The method of claim 26 wherein the panels are oriented so that the first and third positions and second and fourth positions are spaced from each other in the other of the radial and axial directions.

28. A method of creating the appearance of flashes along an axis to an observer viewing the flashes from a first position, the method comprising:

providing a central support extending along the axis and rotatable about the axis;

mounting a first flash panel to the support by way of a first elongate arm which extends in a substantially radial direction away from the support and its axis;

rotating the arm and first flash panel about the axis;

causing the first flash panel to appear to flash to the observer located at the first position as an incident of the flash panel rotation such that a line extending between the first position and the flash does not extend through the axis.

29. The method of claim 28 wherein the flash panel is provided with reflective material on either side thereof and is caused to appear to flash at second and third positions spaced 180° around the axis from each other with the flashes at the second and third positions being viewable from the first position.

30. The method of claim 29 further including the step of mounting a second flash panel to the support by way of a second elongate arm which extends radially away from the axis, and spacing said second flash panel from the first panel in at least one of (1) an axial direction along the axis, (2) a radially outward direction from the axis, and (3) an angular direction about the axis.

31. An apparatus for attracting the attention of an observer with separate unconnected flashes on either side of a fixed axis by flash panels which are rotatable about the axis with the flashes appearing at a first position on one side of the axis and a second position on the other side of the axis, the apparatus comprising:

first and second flash panels spaced radially outwardly from the axis so that at least one of the first and second flash panels and the axis define a first reference plane which extends radially from the axis with the one flash panel generally extending along the first reference plane; and means for moving the first and second flash panels through the first and second positions, respectively, with the panels each causing the appearance of a flash as they are moved through the respective first and second positions on either side of the axis so that the flashes at the first and second positions appear to be unconnected relative to each other.

32. The apparatus of claim 31 wherein the other of the first and second flash panels and the axis define a second reference plane which extends radially from the axis with the other panel generally extending along the second reference plane.

33. The apparatus of claim 32 wherein the moving means comprises a central support extending longitudinally along the axis and rotatable about the axis and first and second arms extending radially from the support along the first and second reference planes, respectively, for carrying the first and second flash panels as they are rotated through the first and second positions.

34. The apparatus of claim 32 wherein the flash panels are curved so as to include surface portions which extend slightly beyond their respective reference planes.

35. The apparatus of claim 34 wherein the first and second flash panels are spaced from each other in at least one of (1) an axial direction along the axis, (2) a radially outward direction from the axis, and (3) an angular direction about the axis.

36. An apparatus for causing the appearance of flashes along a fixed axis to attract the attention of an observer viewing the flashes from a first position, the apparatus comprising:

a central support extending longitudinally along the axis;

a first arm connected to the support and extending in a radial direction away from the support;

a first enlarged flash panel mounted to the arm distal from the support; and means for rotating the flash panel about the axis causing the flash panel to appear to flash to the observer at the first position as the flash panel is rotated such that a line extending between the observers first viewing position and the flash does not extend through the axis.

37. The apparatus of claim 36 further including a second arm connected to the support and extending in a radial direction away from the support and a second enlarged flash panel mounted to the arm distal from the support with the first and second panels being spaced from each other axially, radially and angularly about the fixed axis.

38. The apparatus of claim 37 wherein the flash panels each include opposite flash surfaces, and reflective material is attached on both flash surfaces of each of the panels to cause the appearance of flashing on either side of the axis by each of the panels as they are rotated about the axis.

39. An apparatus for causing the appearance flashes on either side of an axis to attract the attention of an observer viewing the flashes from a first position, the apparatus comprising:

a flash panel having opposite flash surfaces and being rotatable about the axis, the flash panel including a mount for carrying the panel in spaced relation relative to the axis;

means for rotating the flash panel about the axis so that on one side of the axis one of the opposite flash surfaces faces towards the first position and on the other side of the axis the other of the flash surfaces faces towards the first position; and reflective material attached on both flash surfaces to cause the appearance of flashing on either side of the axis as the flash portion is rotated about the axis.

* * * * *